United States Patent [19]

Geiser

[11] 3,977,994

[45] Aug. 31, 1976

[54] RUST INHIBITING COMPOSITION

[75] Inventor: Edward M. Geiser, Downers Grove, Ill.

[73] Assignee: Universal Oil Products Company, Des Plaines, Ill.

[22] Filed: June 24, 1974

[21] Appl. No.: 482,123

[52] U.S. Cl. ..... 252/392; 21/2.5 R; 21/2.7 R; 106/14; 148/6.14 R; 252/396

[51] Int. Cl.[2] ..... C23F 11/14

[58] Field of Search ..... 252/392, 396; 106/14; 21/2.7 R, 2.5 R; 148/6.14 R

[56] References Cited

UNITED STATES PATENTS

| | | | |
|---|---|---|---|
| 2,951,041 | 8/1960 | Saunders | 252/392 |
| 3,034,907 | 5/1962 | Kleemann et al. | 252/392 |
| 3,106,533 | 8/1963 | Hallowell | 252/392 |
| 3,444,090 | 5/1969 | Michal | 252/392 |

*Primary Examiner*—Leland A. Sebastian
*Assistant Examiner*—Irwin Gluck
*Attorney, Agent, or Firm*—James R. Hoatson, Jr.; Raymond H. Nelson; William H. Page, II

[57] ABSTRACT

A composition which will inhibit the formation of rust on the surface of a metal consists of a mixture of an organic acid, an N-alkyl- or cycloalkyl-substituted ethanolamine, at least one emulsifying agent and water.

10 Claims, No Drawings

RUST INHIBITING COMPOSITION

This invention relates to novel compositions which are useful for protecting metal surfaces. More specifically the invention is concerned with a novel composition which will inhibit the formation of rust on metal surfaces.

In many instances metal surfaces which are exposed to the elements such as air which contains a relatively high percentage of water thus resulting in high humidity will tend to be subject to the oxidative processes which result in the formation of compounds such as iron oxide on the surface of the metal. This formation of rust on the surface of the metal will have a deleterious effect on said metal resulting in a program of renovation of the surface of the metal. This renovation process may be time-consuming and expensive inasmuch as, in the event that the metal surface which is attacked is part of a machine or apparatus, said machine or apparatus may have to be shut down or taken out of use while the aforesaid renovative process takes place. Likewise, metals when stored for periods of time may also be subject to oxidative deterioration with the resulting formation of an unwanted oxide on the surface of the metal. Thus, when the pieces of metal are to be used, they must also undergo a renovation or repair of the surface in order to make said pieces of metal useful for the purpose intended. In order to prevent this oxidative attack on the surface of the metal, it is necessary to coat the surface of the metal with a composition which will prevent or retard the unwanted formation of the oxide on the surface thereof.

It is therefore an object of this invention to provide a composition which will inhibit the formation of metal oxide on the surface of the metal.

In one aspect an embodiment of this invention resides in a composition for inhibiting the formation of rust on metal surfaces which comprises a mixture of an organic acid containing from 16 to 20 carbon atoms, an N-alkyl- or cycloalkyl-substituted ethanolamine, at least one emulsifying agent and water.

A specific embodiment of this invention is found in a composition for inhibiting the formation of rust on metal surfaces, said composition comprising a mixture of stearic acid, N-(1-methylheptyl)-ethanolamine, at least one emulsifying agent and water.

Other objects and embodiments will be found in the following further detailed description of the present invention.

As hereinbefore set forth, the present invention is concerned with a composition which is intended to inhibit the formation of rust on metal surfaces. This composition will comprise a mixture of an organic acid which, in the preferred embodiment of this invention, contains from 16 to about 20 carbon atoms, an N-alkyl- or cycloalkyl-substituted ethanolamine in which the alkyl substituent will contain from 3 to about 12 carbon atoms or said cycloalkyl substituent will contain from 3 to about 8 carbon atoms, at least one emulsifying agent and water, the specific concentrations of the various components of the mixture being hereinafter set forth in greater detail.

The organic acid which contains from 3 to about 20 carbon atoms will, in the preferred embodiment of the invention, comprise a saturated fatty acid such as palmitic acid, margaric acid, stearic acid, nondecylic acid, arachidic acid, etc. However, it is also contemplated within the scope of this invention that unsaturated acids of the acrylic acid series containing from 16 to about 20 carbon atoms may also be used, some specific examples of these acids including the various isomers such as hypogaeic acid, heptadecylenic acid, elaidic acid, oleic acid, gynocardic acid, the isomeric nondecylenic acids and the isomeric eicosenic acids such as gadoleic acid, etc. It is to be understood that the aforementioned acids are only representative of the type of acids which may be used in the composition of the present invention, and that other acids containing less than 16 carbon atoms or more than 20 carbon atoms may also be used, however, not necessarily with equivalent results.

The second component of the rust inhibiting compositions comprises an N-alkyl- or N-cycloalkyl-substituted ethanolamine in which the alkyl substituents, either straight or branched chain in nature, will contain from about 3 to about 12 carbon atoms and the cycloalkyl substituents will contain from 3 to about 8 carbon atoms. Some representative examples of these substituted ethanolamines will include N-(propyl)-ethanolamine, N-(isopropyl)-ethanolamine, N-(n-butyl)-ethanolamine, N-(sec-butyl)-ethanolamine, N-(t-butyl)-ethanolamine, N-(n-pentyl)-ethanolamine, N-(n-hexyl)-ethanolamine, N-(n-heptyl)-ethanolamine, N-(n-octyl)-ethanolamine, N-(n-nonyl)-ethanolamine, N-(n-decyl)-ethanolamine, N-(n-undecyl)-ethanolamine, N-(n-dodecyl)-ethanolamine, N-(2-methylpentyl)-ethanolamine, N-(2-ethylpentyl)-ethanolamine N-(1-methylhexyl)-ethanolamine, N-(1-methylheptyl)-ethanolamine, N-(1-methyloctyl)-ethanolamine, N-(1-methylnonyl)-ethanolamine, N-(1-methyldecyl)-ethanolamine, N-(1-methylundecyl)-ethanolamine, N-(2-methylhexyl)-ethanolamine, N-(2-methylheptyl)-ethanolamine, N-(2-methyloctyl)-ethanolamine, N-(1-ethylhexyl)-ethanolamine, N-(1-ethylheptyl)-ethanolamine, N-(1-ethyloctyl)-ethanolamine, N-(1-ethylnonyl)-ethanolamine, N-(1-ethyldecyl)-ethanolamine, N-(1-ethyl-2-methylpentyl)-ethanolamine, N-(1-ethyl-2-methylhexyl)-ethanolamine, N-(1-ethyl-2-methylheptyl)-ethanolamine, N-(1-ethyl-2-methyloctyl)-ethanolamine, N-(1-ethyl-3-methylpentyl)-ethanolamine, N-(1-ethyl-3-methylhexyl)-ethanolamine, N-(1-ethyl-3-methylheptyl)-ethanolamine, N-(1-ethyl-3-methyloctyl)-ethanolamine, etc., N-(cyclopropyl)-ethanolamine, N-(cyclobutyl)-ethanolamine, N-(cyclopentyl)-ethanolamine, N-(cyclohexyl)-ethanolamine, N-(cycloheptyl)-ethanolamine, N-(cyclooctyl)-ethanolamine, etc. As in the case of the long chain acids, it is to be understood that these substituted ethanolamines are only representative of the class of compounds which may be used, and that the present invention is not necessarily limited thereto.

The aforementioned acids and substituted ethanolamines are utilized in a water emulsified mixture, the emulsification being accomplished by the use of at least one emulsifying agent and, in the preferred embodiment of the invention, two emulsifying agents. The emulsifying agents, in the event that more than one is used, will be utilized in such a manner so that the proper HLB number is reached. The term HLB as used in the present specification will refer to the hydrophile-lipophile balance. As is known in the art, all emulsifying agents or surfactants contain both hydrophilic or water-loving and lipophilic or oil-loving groups. Commercial surfactants are either hydrophilic or lipophilic in nature and have been assigned HLB values. If the value which is assigned to a particular surfactant is between 0 and 10 the surfactant is lipophilic in nature while conversely if the HLB value assigned to a surfactant is between 10 and 20 the surfactant is hydrophilic in nature. By blending two or more emulsifiers it is possible to obtain a value which is approximately midway between 0 and 20 or 10 and therefore will permit an emulsion wherein the fatty acid and the ethanolamine will be uniformly dispersed in the water carrier of the composition of the present invention. Some examples of the type of surfactants which may be used as emulsifiers of the present invention will include sorbitan derivatives. The sorbitans are cyclic ether tetrahydric alcohols or anhydrides of sorbitol. Some specific examples of these emulsifiers comprise sorbitan monolaurate, sorbitan monopalmitate, sorbitan monostearate, sorbitan tristearate, sorbitan monooleate, sorbitan trioleate, sorbitan sesquioleate, these emulsifiers being lipophilic in nature or polyoxyethylene sorbitan monolaurate, polyoxyethylene sorbitan monopalmitate, polyoxyethylene sorbitan monostearate, polyoxyethylene sorbitan tristearate, polyoxyethylene sorbitan monooleate, polyoxyethylene sorbitan trioleate, these emulsifiers being hydrophilic in nature. The aforementioned emulsifiers are sold under the tradenames Span and Tween by the Atlas Powder Company. It is also to be understood that other emulsifiers such as glycerol sorbitan laurate, glycerol mannitan laurate, polyoxyethylene lauryl ether, polyoxyethylene oleyl ether, polyoxyethylene stearate, polyoxyethylene palmitate, polyoxyethylene sorbitol laurate, polyoxyethylene sorbitol hexaoleate, glycerol monooleate, etc. may also be used.

The novel rust inhibiting compositions of the present invention will contain the organic acid which contains from about 16 to about 20 carbon atoms in the chain in an amount in the range of from about 0.5 to about 2.5% by weight, the N-alkyl-substituted or N-cycloalkyl-substituted ethanolamine in an amount in the range of from about 0.1 to about 5% by weight, the emulsifying agent or agents in an amount in the range of from about 1.5 to about 18% by weight and water in a range of from about 74.5 to about 97.8% by weight. The desired composition is prepared by any means known in the art. For example, when more than one emulsifying agent is used, a mixture of a hydrophilic and a lipophilic emulsifying agent is prepared, the composition of the mixture of emulsifying agents being such that the HLB is approximately 10. As an illustrative example of this, a mixture of emulsifying agents comprising sorbitol monostearate sold under the tradename Span 60 and polyoxyethylene sorbitan monostearate sold under the tradename Tween 60 is admixed. The HLB value of the Span 60 is 4.7 while the HLB value of the Tween 60 is 14.9. By utilizing 40% of the Span 60 and 60% of the Tween 60 it is possible to obtain an emulsifying mixture which possesses an HLB value of 10.8. This mixture is then admixed with the organic acid and the ethanolamine and water and the resulting composition is then applied to the metal surface to be coated by roller coating, as is possible with steel sheets, by spraying, brushing, dipping, etc. The desired length of time of protection of the metal surface may be varied according to the concentration and ratio of the N-alkyl-substituted or N-cycloalkyl-substituted ethanolamine and the organic acid. As hereinbefore set forth the admixing of the various components of the composition may be effected in any suitable manner such as by physical admixture with continuous agitation or stirring of the components in a suitable reaction vessel or pot.

The following examples are given to illustrate the novel rust inhibiting compositions of the present invention and to their use thereof. However, these examples are not intended to limit the generally broad scope of the present invention in strict accordance therewith.

EXAMPLE I

In this example a rust inhibiting composition was prepared by admixing 0.1% by weight of N-(1-methylheptyl)-ethanolamine, 1.5% by weight of stearic acid and 5.0% by weight of a mixture of sorbitan monostearate and polyoxyethylene sorbitan monostearate in 93.4% of water. The resulting water emulsified composition was then roller coated on a rolled steel sheet. This sheet was contrasted to a rolled sheet of steel which was left unprotected. The unprotected steel sheet exhibited a rusted surface in a period of 5 to 7 days, while in contrast to this, the rolled sheet of steel which was protected by the coating of the rust inhibiting composition was protected for 25 days.

To illustrate the efficiency of the compositions of the present invention, another water emulsified mixture was prepared which contained 3% of N-(1-methylheptyl)-ethanolamine in place of the 0.1% of the substituted ethanolamine in the preceding paragraph. A sheet of rolled steel which was roller coated with the latter composition was protected against rust for a period of from 45 to 60 days, the length of protection being dependent upon the humidity of the storage area.

EXAMPLE II

In like manner, a rust inhibiting composition is prepared by admixing 2% by weight of margaric acid along with 3% of N-(1-ethyl-3-methylpentyl)-ethanolamine and 6.5% by weight of a mixture of 55% of sorbitan monopalmitate sold under the tradename Span 40 and 45% of polyoxyethylene sorbitan monopalmitate sold under the tradename Tween 40. The admixture is placed in 88.5% bu weight of water and thoroughly agitated for a period of 10 minutes. The resulting water emulsified composition is roller coated on a sheet of steel and the sheet along with an unprotected sheet of rolled steel is placed in a storage area. The unprotected steel sheet will exhibit signs of rust in a period of 5 to 7 days, depending again upon the humidity of the storage area while the protected sheet of steel will not exhibit any signs of rust until a much longer period of time has elapsed.

EXAMPLE III

In a manner similar to that hereinbefore set forth above, a water emulsified composition is prepared by admixing 1.5% by weight of oleic acid, 3% by weight of N-(cycloheptyl)-ethanolamine and 5.0% by weight of a mixture consisting of 50% by weight of sorbitan monolaurate sold under the tradename Span 20 and 50% by weight of polyoxyethylene sorbitan monolaurate sold under the tradename Tween 21 in 90.5% by weight of water. The components of the mixture are thoroughly agitated and stirred for a period of 15 minutes at the end of which time a sheet of rolled steel is roller coated with the rust inhibiting composition. A comparison of the surface of this sheet of rolled steel with a sheet of rolled steel which is not protected by any rust inhibiting composition will disclose the fact that the unprotected steel wil exhibit signs of rust in approximately 5 to 7 days as compared to the protected steel which will be rustproof for a considerably longer period of time.

EXAMPLE IV

In this example a rust inhibiting composition is prepared by admixing 0.5% by weight of arachidic acid, 3% by weight of N-(1-methylheptyl)-ethanolamine and 4.0% by weight of an emulsifying mixture consisting of 50% by weight of sorbitan monooleate sold under the tradename of Span 80 and 50% by weight of polyoxyethylene sorbitan monolaurate sold under the tradename Tween 20 along with 92.5% by weight of water. As in the preceding examples, the mixture is thoroughly agitated for a period of 15 minutes and the resulting water emulsified rust inhibiting composition is roller coated on a sheet of rolled steel. The sheet of rolled steel which is protected by this composition will be rust-free after a considerable period of time in storage, this rust-free appearance being contrasted to the appearance of a sheet of rolled steel which is not protected by any rust inhibiting composition, the latter surface exhibiting signs of rust after a period of 5 days.

I claim as my invention:

1. A rust inhibiting composition consisting essentially of an emulsion of from about 0.5 to about 2.5% by weight of an organic acid containing from 16 to 20 carbon atoms and from about 0.1 to about 5% by weight of an N-alkyl or N-cycloalkyl ethanolamine in water.

2. The composition as set forth in claim 1 in which the alkyl substituent of said N-alkyl ethanolamine contains from 3 to 12 carbon atoms.

3. The composition as set forth in claim 1 in which the cycloalkyl substituent of said N-cycloalkyl- ethanolamine contains from 3 to 8 carbon atoms.

4. The composition as set forth in claim 1 in which said organic acid is stearic acid.

5. The composition as set forth in claim 1 in which said organic acid is margaric acid.

6. The composition as set forth in claim 1 in which said organic acid is arachidic acid.

7. The composition as set forth in claim 1 in which said organic acid is oleic acid.

8. The composition as set forth in claim 1 in which said N-alkyl-ethanolamine is N-(1-methylheptyl)-ethanolamine.

9. The composition as set forth in claim 1 in which said N-alkyl-ethanolamine is N-(1-ethyl-3-methylpentyl)-ethanolamine.

10. The composition as set forth in claim 1 in which said N-cycloalkyl- ethanolamine is N-(cyclohexyl)-ethanolamine.

* * * * *